US007237282B2

(12) United States Patent
Beck et al.

(10) Patent No.: US 7,237,282 B2
(45) Date of Patent: Jul. 3, 2007

(54) STACKABLE AND STABLE BEDDING FOUNDATION

(75) Inventors: Daniel J. Beck, Carthage, MO (US); Jacob Neuenswander, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 171 days.

(21) Appl. No.: 11/037,928

(22) Filed: Jan. 18, 2005

(65) Prior Publication Data

US 2006/0156470 A1 Jul. 20, 2006

(51) Int. Cl.
*A47C 23/00* (2006.01)

(52) U.S. Cl. ..... 5/247; 5/255; 267/103

(58) Field of Classification Search ..... 5/247, 5/255, 260, 264.1, 265–266; 267/103–107, 267/95

See application file for complete search history.

(56) References Cited

U.S. PATENT DOCUMENTS

| | | | |
|---|---|---|---|
| 136,473 | A | 3/1873 | Ward |
| 197,405 | A | 11/1877 | Read |
| 727,265 | A | 5/1903 | Beall |
| 2,415,765 | A | 2/1947 | Schmidt |
| 2,979,739 | A | 4/1961 | Krakauer |
| 3,561,021 | A | 2/1971 | Slominski |
| 3,722,013 | A | 3/1973 | Surletta |
| 3,725,965 | A | 4/1973 | Smith et al. |
| 3,852,838 | A | 12/1974 | Slominski et al. |
| 3,953,903 | A | 5/1976 | Lawrence et al. |
| 3,990,121 | A | 11/1976 | Whitaker |
| 4,000,531 | A | 1/1977 | Inman |
| 4,012,802 | A | 3/1977 | Hutchinson et al. |
| 4,069,525 | A | 1/1978 | Valoff |
| 4,112,528 | A | 9/1978 | Higgins |
| 4,120,058 | A | 10/1978 | Kitchen et al. |
| 4,377,279 | A | 3/1983 | Schulz, Jr. et al. |
| 4,488,712 | A | 12/1984 | Higgins |
| 4,555,097 | A | 11/1985 | Hiatt |
| 4,639,957 | A | 2/1987 | Wells et al. |
| 4,657,231 | A | 4/1987 | Surletta |
| 4,739,977 | A | 4/1988 | Dabney |
| 4,771,995 | A | 9/1988 | Wells et al. |
| 4,891,853 | A | 1/1990 | Dabney |
| 4,903,949 | A | 2/1990 | Schulz, Jr. |
| 4,960,267 | A | 10/1990 | Scott |
| 5,052,064 | A | 10/1991 | Hagemeister et al. |
| 5,104,099 | A | 4/1992 | Long |
| 5,165,125 | A | 11/1992 | Callaway |
| 5,176,367 | A | 1/1993 | Rodgers et al. |
| 5,178,372 | A | 1/1993 | Rodgers et al. |

(Continued)

*Primary Examiner*—Patricia Engle
*Assistant Examiner*—Fredrick Conley
(74) *Attorney, Agent, or Firm*—Wood, Herron & Evans, LLP

(57) ABSTRACT

A nestably stackable bedding foundation assembly replaces the traditional border wire and disposed coil spring foundation assembly in a so-called box spring. The foundation assembly may be nestably stacked with numerous other such assemblies for transportation, thereby avoiding the need to compress and tie the assembly for shipping. Each foundation assembly includes a number of corrugated support wires having alternating peaks and valleys. The valleys of selected support wires are twisted relative to their associated peaks to provide a more stable mounting to a base and offer a variety of firmness to specific zones of the assembly.

20 Claims, 6 Drawing Sheets

U.S. PATENT DOCUMENTS 5,246,210 A 9/1993 Dabney et al.
5,332,202 A 7/1994 Wagner et al.
5,346,188 A 9/1994 Rodgers et al.
5,346,190 A 9/1994 Dabney
5,361,434 A 11/1994 Hagemeister et al.
5,370,374 A 12/1994 Rodgers et al.
5,395,097 A 3/1995 Dabney et al.
5,401,007 A 3/1995 Dabney et al.
5,414,874 A 5/1995 Wagner et al.
5,426,799 A 6/1995 Ottiger et al.
5,435,023 A 7/1995 Wagner et al.
5,588,165 A 12/1996 Fromme
5,622,357 A 4/1997 Schulz, Jr. et al.
5,652,986 A 8/1997 Wells
5,704,595 A * 1/1998 Kitchen et al. ..... 267/103
5,720,471 A 2/1998 Constantinescu et al.
5,803,440 A 9/1998 Wells
5,927,696 A 7/1999 Hagemeister
5,967,499 A 10/1999 McCraw et al.
6,108,834 A 8/2000 Mauro et al.
6,134,729 A 10/2000 Quintile et al.
6,149,143 A 11/2000 Richmond et al.
6,406,009 B1 6/2002 Constantinescu et al.
6,484,339 B2 11/2002 Mossbeck et al.
6,578,213 B2 6/2003 Dabney
6,651,276 B2 11/2003 McCraw et al.

* cited by examiner

STACKABLE AND STABLE BEDDING FOUNDATION

BACKGROUND OF THE INVENTION

This invention relates generally to bedding, and more particularly to a nestably stackable bedding foundation.

Bedding foundations or so-called box spring assemblies generally include spaced border wires between which coil or bent wire spring modules are located. As thus manufactured, these box spring assemblies are bulky and shipping them to the manufacturer for application of padding and covering thereto is costly because of space requirements. To reduce the space requirements, it is customary to compress the assemblies to reduce their individual thicknesses and to tie them in their compressed state. This involves using presses and ties which are expensive, and the extra operations of pressing and tying the assemblies also adds to their manufacturing cost. At the delivery end, the manufacturer must cut and discard the ties before applying the covering. These additional material and handling expenses increase the end cost of box spring assemblies.

Box spring assemblies by their very nature are intended to provide a stable support foundation for mattresses or other bedding placed on top thereof. Toward that end, the spring modules used in the box spring assemblies should be securely and firmly mounted in the assembly to avoid any wobble or shifting during use.

In some cases, bedding systems become unevenly depressed, often due to uneven loading. It is well recognized that the middle regions of a bedding system support a greater amount of the user's weight focused in the torso regions. Users commonly do not rotate or flip bedding systems as is often recommended to avoid uneven wear. Alternatively, bedding systems desirably provide differing support characteristics or firmness to different areas or regions of the bed to provide extended wear, durability and/or comfort to the user.

Therefore, a bedding foundation assembly that can be stacked for shipping without having to compress and tie the assembly would be a significant improvement.

Additionally, a bedding foundation assembly which is relatively simple to manufacture, and which may substitute for a traditional box spring assembly having coil spring modules is also desirable.

Moreover, such a bedding foundation must provide a reliable and stable support surface for mattresses and other bedding products, preferably one which can be easily tailored with specific regions or zones of varying firmness.

SUMMARY OF THE INVENTION

This invention provides a solution to these and other problems in the art. In one embodiment, this invention is a nestably stackable bedding foundation assembly for use in place of the traditional box spring assembly. This bedding foundation assembly includes a rectangular border wire and transversely-spaced, parallel, and longitudinally-extending support wires parallel to the border wire sides and with ends connected to the border wire ends. These support wires are generally corrugated along their lengths, having peaks and valleys with the peaks being generally coplanar with the plane defined by the border wire and the valleys being displaced beneath and intermediate of the peaks. Longitudinally-spaced, parallel and transversely-extending upper connector wires are parallel to the border wire ends and connected along their lengths to the peaks of the support wires. Longitudinally-spaced, parallel, and transversely-extending lower connector wires are parallel to the border wire ends and may be connected to the valleys of the support wires in certain embodiments of this invention.

The longitudinal voids between the peaks of the support wires are of a greater dimension than the valleys of the support wires. This configuration enables one bedding foundation assembly of this invention to be nestedly stacked atop a second assembly since the support wire valleys of the first assembly fit into the voids between the peaks of the support wires of the second assembly. Such a nested and stacked arrangement results in a total height dimension which is less than the sum of the individual assembly height dimensions.

The valleys of the support wires of this invention are uniquely configured to provide specific advantages to the bedding foundation. In one embodiment, selected valleys of the support wires are twisted or oriented relative to the remainder of the support wire. Selected support wire valleys are twisted, possibly 45° or 90° relative to the adjacent portions of the support wires to provide a more stable and substantial mounting and attachment of the support wire valley to a base frame. The twisted orientation of the spring wire valleys can be varied throughout the foundation unit to provide differing firmness and other characteristics to the associated regions or zones of the unit.

One advantage of this invention is that it enables relatively inexpensive bedding foundation wire cores to be tightly nested, compacted and shipped in a minimum of space to an assembly destination, thereby reducing the ultimate cost of the unit to the assembler.

Another advantage of this invention is that bedding foundation assemblies may be rapidly loaded by a manufacturer for transportation to the destination of assembly without the need for compressing and tying the assemblies together.

Yet another advantage of this invention is avoiding the need for costly presses and ties necessary to compress a conventional box spring assembly for transportation.

A further advantage of this invention is that bedding foundation assemblies may be rapidly unloaded without the time consuming and labor intensive tasks of clipping and discarding the tie wires used to hold conventional box spring assemblies in a compressed state.

A still further advantage is to provide such a foundation assembly that is both stable and secure when in use to support a mattress or the like and provide different firmness regions or zones to the assembly.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
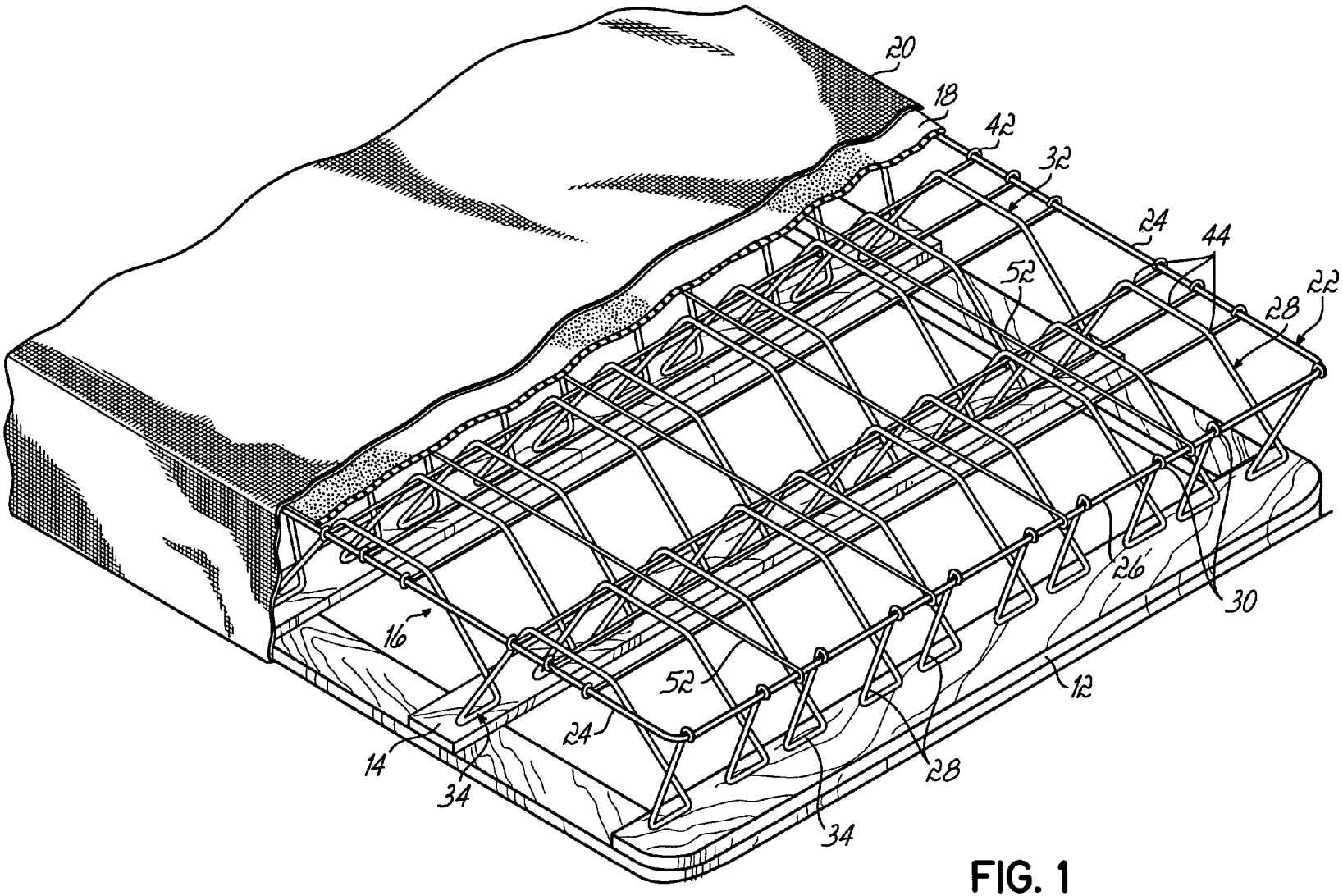
FIG. 1 is a perspective view, partially broken away, of a bedding foundation assembly according to one embodiment of this invention.

Referring first to FIG. 1, a bedding foundation assembly 10 according to one embodiment of this invention is illustrated. The foundation 10 has a rectangular wooden base frame 12 on which transverse wooden slats 14 are attached. A nestably stackable spring assembly or wire core 16 is atop these transverse slats 14. A foam pad 18 overlies the nestably stackable spring assembly 16, and a fabric covering 20 overlies the foam pad 18 and surrounds the nestably stackable assembly 16 and the base frame 12.

The nestably stackable assembly 16 includes a rectangular steel border wire 22 having two parallel sides 24, 24 and two parallel ends 26, 26. The parallel sides 24, 24 are longer than the parallel ends 26, 26. Transversely-spaced, parallel, and longitudinally-extending steel support wires 28 are parallel to the border wire sides 24, 24 and have ends 30 which are crimped around the ends 26, 26 of the border wire 22. These support wires 28 are formed so as to be generally corrugatedly-shaped along their lengths, having peaks 32 and valleys 34. These peaks 32 and valleys 34 are flattened at their respective distal portions 36 and 38, respectively. The adjacent distal portions 36, 38 are joined together by connecting portions 39 of the support wire 28. According to various embodiments of this invention, these valleys 38 are twisted relative to the plane defined by the peaks 36 being vertically spaced beneath and intermediate of the flattened peaks 36.

Longitudinally-spaced, parallel, and transversely-extending steel upper connector wires 40 extend parallel to the border wire ends 26, 26 and have ends 42 which are crimped around the border wire sides 24, 24. These upper connector wires 40 are welded intermediate of their ends 42, 42 along their lengths at 44 to the flattened peaks 36 of the support wires 28.

Longitudinally-spaced, parallel, and transversely-extending steel lower connector wires 46 extend along the selected slats 14 and parallel to the border wire ends 26, 26 in some embodiments (see FIGS. 6-10) and are welded at their ends 48 and along their lengths at 50 to the flattened valleys 38 of the support wires 28.

The support wires 28 have flattened distal peak portions 36 and flattened distal valley portions 38, with the support wire ends 30 being crimped around the border wire 22. In this embodiment, three upper connector wires 40 per flattened distal peak portion 36 are illustrated. The distal valley portions 38 of the support wires 28 may be stapled or otherwise attached to the transverse slats 14 which are in turn affixed to the base frame 12.

If desired, additional steel end wires (not shown) may be added either before or after the stackable assembly 16 has reached its final assembly destination. These end wires have spaced ends which are crimped around the border wire 22 and the endmost upper connector wire 40, respectively. These end wires provide additional stiffness to the stackable assembly 16 in an edge most location of the ends of the assembly 16 so as to prevent the end border wires from deflecting and being permanently distorted when a person sits on the end of a bed of which the foundation forms a part. Such steel end wires are shown in U.S. Pat. No. 5,361,434 which is hereby incorporated by reference in its entirety.

Referring again to FIG. 1, continuous longitudinal wires 52 are included. These longitudinal wires 52 have their ends crimped around the border wire ends 26, 26. These longitudinal wires 52 may be welded along their lengths to the upper connector wires 40 as desired.

The spring assembly 16 of a bedding foundation 10 is generally manufactured by a supplier, who then ships it to an assembler. The assembler adds to the assembly the wooden base 12, slats 14, padding 18, and upholstery 20 to make a completed product.

Figure 2:
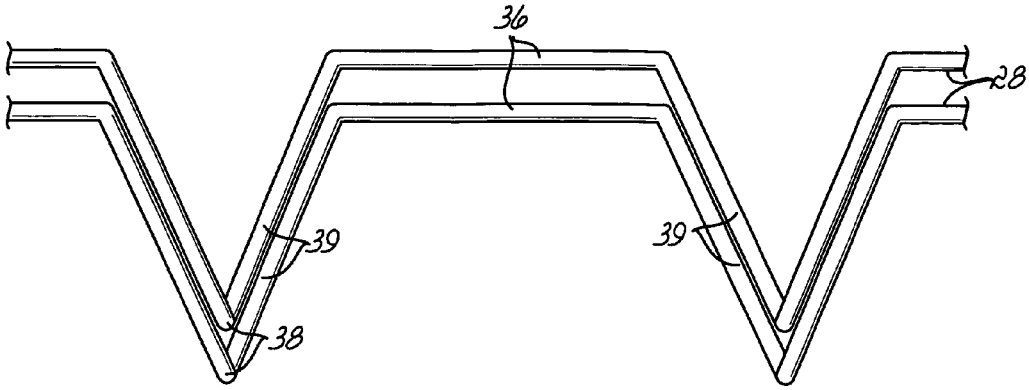
FIG. 2 is a side elevational view illustrating portions of two unmounted foundations stacked and nested one within the other for shipment.

This invention facilitates shipment of the metal core or stackable assembly 16 by a supplier to the assembler. With reference to FIG. 2, a first stackable spring assembly 16 may be placed upon a surface with the flattened distal valley portions 38 of the support wires 28 oriented downwardly and the flattened distal peak portions 36 of the support wires 28 oriented upwardly. Next, a second like assembly 16 is placed atop the first assembly 16, with its flattened distal valley portions 38 and flattened distal peak portions 36 likewise oriented downwardly and upwardly, respectively. The flattened distal valley portions 38 of the second assembly 16 are thereby allowed to enter into the voids between the flattened distal peak portions 36 of the first assembly 16. The second assembly 16 nestles downwardly within the first assembly 16 until the outside dimension of the connecting portions 39 of the valleys 34 of the second assembly 16 is equal to the inside dimension of the connecting portions 39 of the valleys 34 of the first assembly 16. At this point, the second assembly 16 comes to rest within the first assembly 16, with the overall height of the nested assemblies 16, 16 is substantially less than the sum of the individual heights of the assemblies 16, 16. Of course, any number of assemblies 16 may be nested and stacked together for storage or shipment.

One advantage of the spring assembly 16 and associated bedding foundation 10 according to this invention is that the distal valley portions 38 of the support wires 28 are uniquely configured to provide added stability to the bedding foundation 10. In the embodiment of the bedding foundation 10 and associated spring assembly 16 shown in FIG. 1, the distal valley portions 38 of the support wires 28 are twisted or oriented approximately 90° relative to the distal peak portions 36 of the support wire 28. As a result, the flattened distal valley portions 38 of the support wire 28 is more securely mounted to the slats 14 and wooden base frame 12 to provide additional support when the foundation unit 10 is loaded and in use. Nevertheless, the non-parallel, twisted or obliquely oriented distal valley portions 38 of the support wires 28 relative to the distal peak portions 36 does not diminish the ability to nest the spring assemblies 16 with one another as shown in FIG. 2 thereby maintaining this advantage of the invention. In past known spring assemblies for bedding foundations of the type shown in FIG. 1, the support wires were generally planar as shown in U.S. Pat. No. 5,361,434. While such assemblies could be nested, lateral support is enhanced by the orientation of the distal valley portions 38 relative to the distal peak portions 36 of the spring support wires 28 of this invention.

Figure 3:
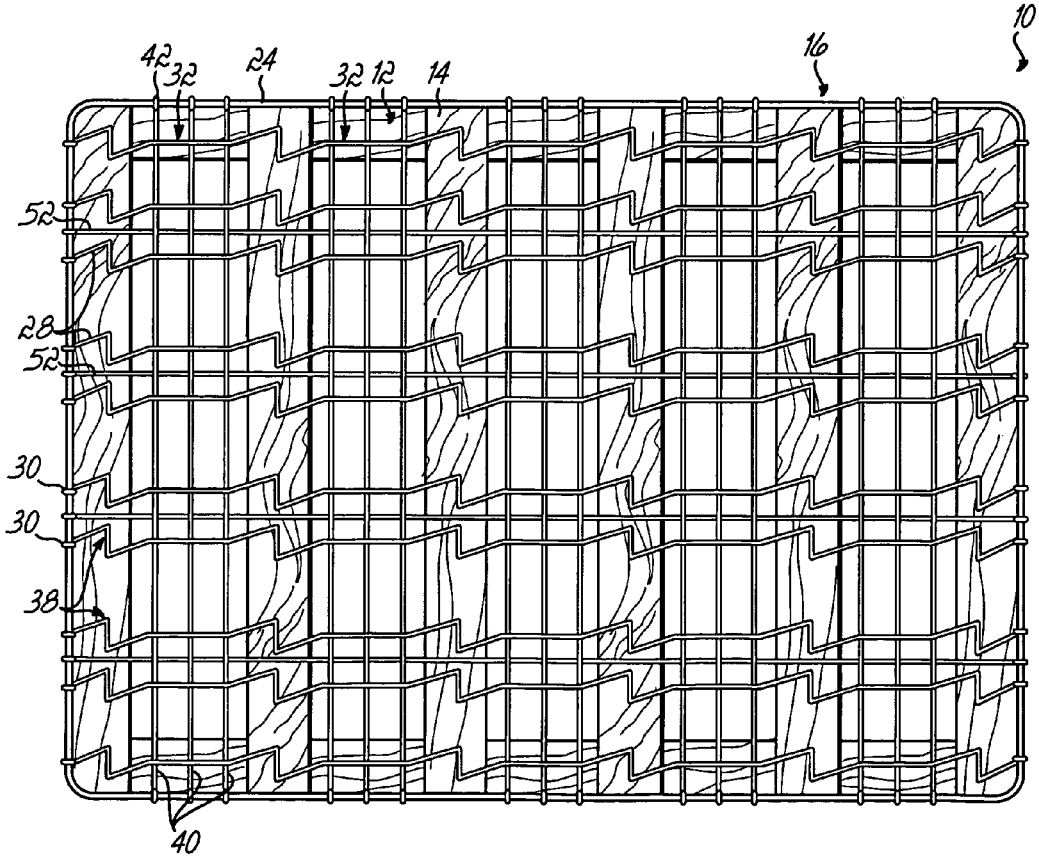
FIGS. 3-10 are each a top plan view of an alternative embodiment of a bedding foundation assembly without a fabric covering according to this invention.

Moreover, a variety of different support wire shapes and configurations can be utilized with this invention. The support wires 28 shown in the foundation unit 10 of FIG. 3 are all generally parallel and similarly configured and oriented with the connecting portion 39 of the support wire 28 between the distal peak and valleys portions all having the same angular inclination. The distal valley portions 38 are oriented about 90° relative to the distal peak portions 36 in FIG. 3.

Figure 4:
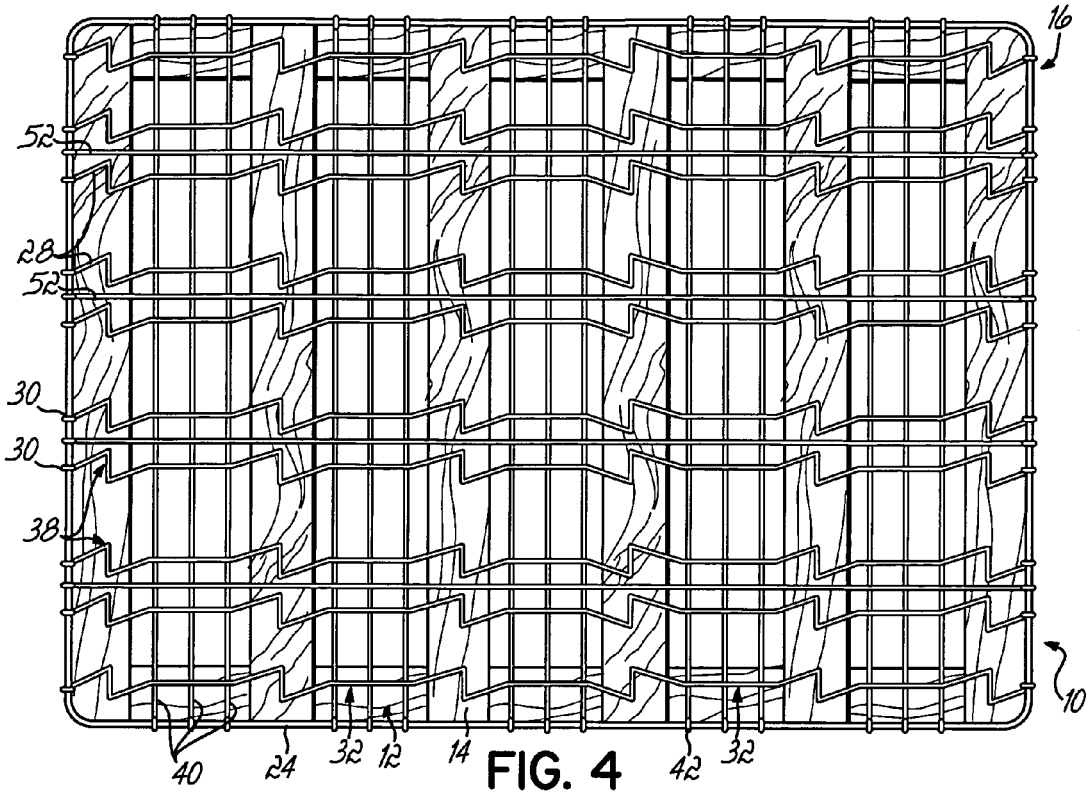

In another alternative embodiment of the foundation unit 10 of this invention as shown in FIG. 4, the connecting portions 39 of the support wires 28 joining the distal valley portions 38 to the distal peak portions 36 are oppositely oriented relative to the adjacent connecting portion 39 of each support wire on the opposite side of each distal peak portion 36. Once again, the support wires 28 are generally parallel in the foundation unit of FIG. 4 and the distal valley portions 38 oriented approximately 90° relative to the adjacent distal peak portions 36.

Figure 5:
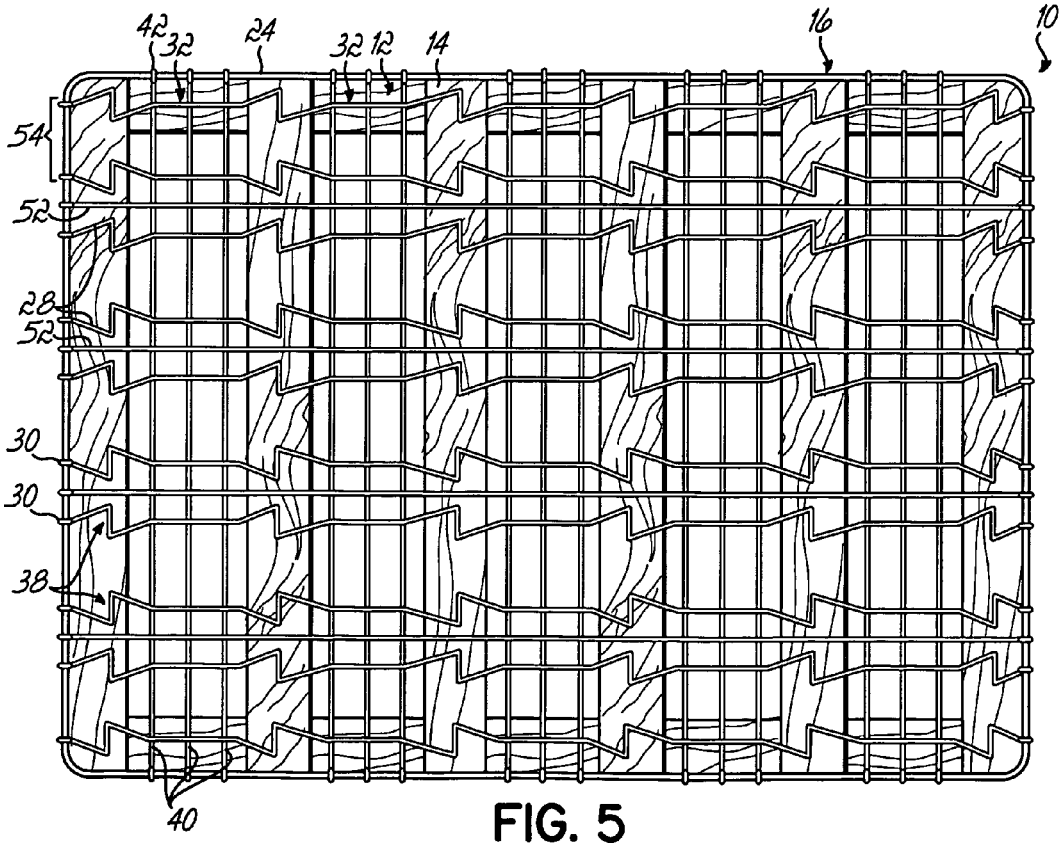

A still further alternative embodiment of the foundation unit 10 is shown in FIG. 5 in which the connecting portions 39 are alternately oriented for each support wire. However, in a variation from the configuration shown in FIGS. 3-4, the support wires 28 are not generally parallel with each another and are grouped in adjacent pairs 54 of oppositely oriented, mirror image support wires 28 in the foundation unit 10.

Figure 6:
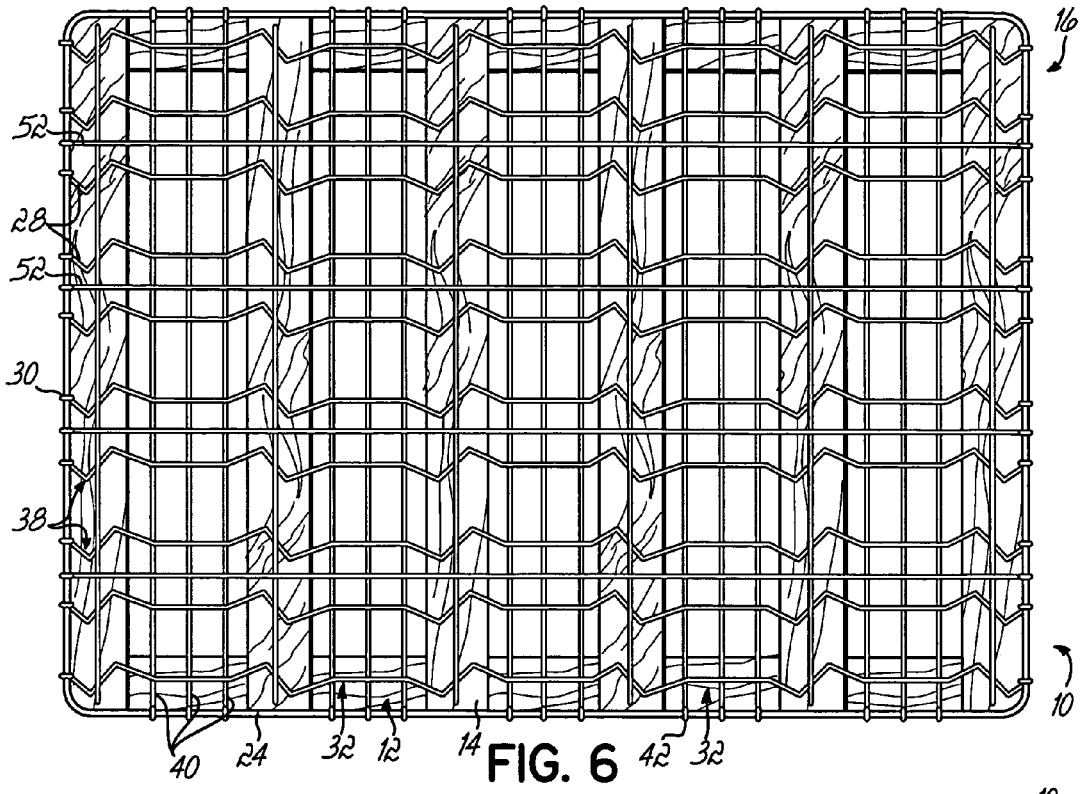

In a still further alternative embodiment shown in FIG. 6, the distal valley portions 38 of the support wires 28 are oriented approximately 45° relative to the distal peak portions 36. With the 45° orientation of the distal valley portions 38, the longitudinally-spaced, parallel and transversely-extending steel lower connecting wires 46 are connected thereto and extend along selected slats 14 and parallel to the border wire ends 26, 26. The lower connecting wires 46 may be welded at 50 to the distal valley portions 38 of the support wires 28. The support wires 28 shown in FIG. 6 are all generally parallel and similarly oriented with respect to each other.

Figure 7:
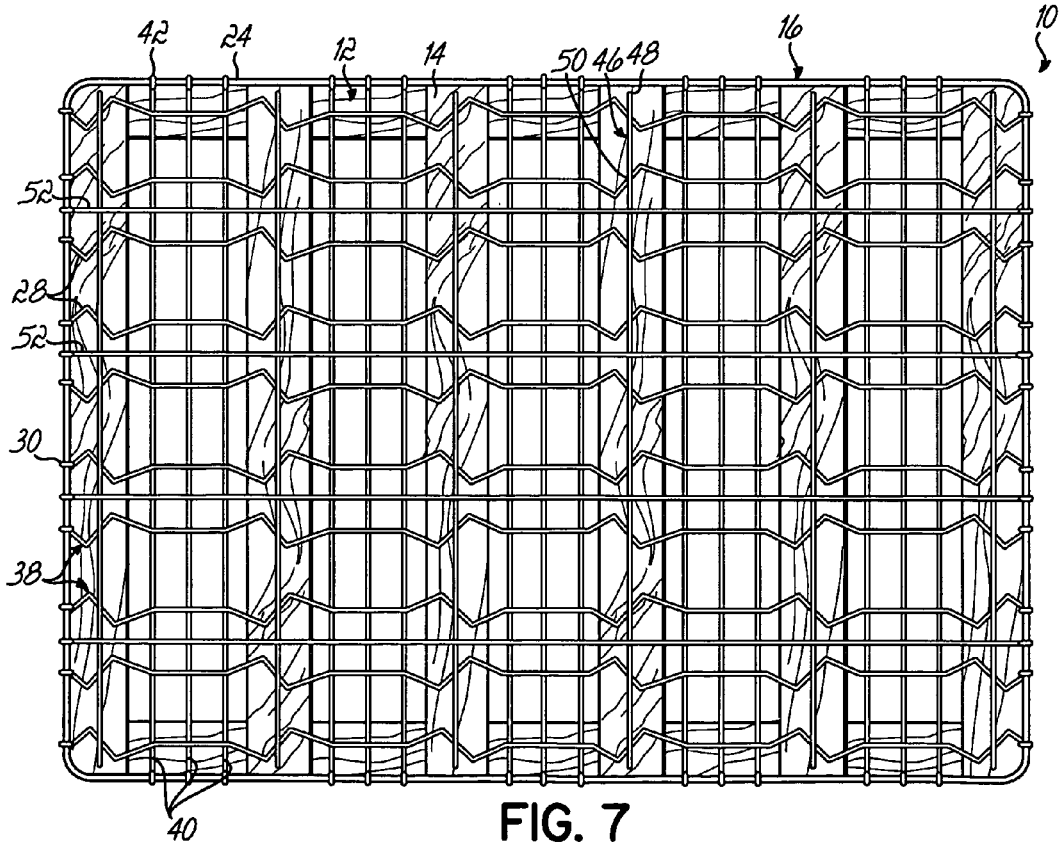

A further alternative embodiment of the foundation unit 10 is shown in FIG. 7 utilizing distal valley portions 38 oriented 45° relative to the distal peak portions 36; however, unlike the orientation shown in FIG. 6, the support wires 28 are not generally parallel with each other but are grouped in adjacent pairs 54 of support wires 28 which are oriented in a mirror image of each other similar to the support wire 28 orientation shown in FIG. 5 in that regard.

Figure 8:
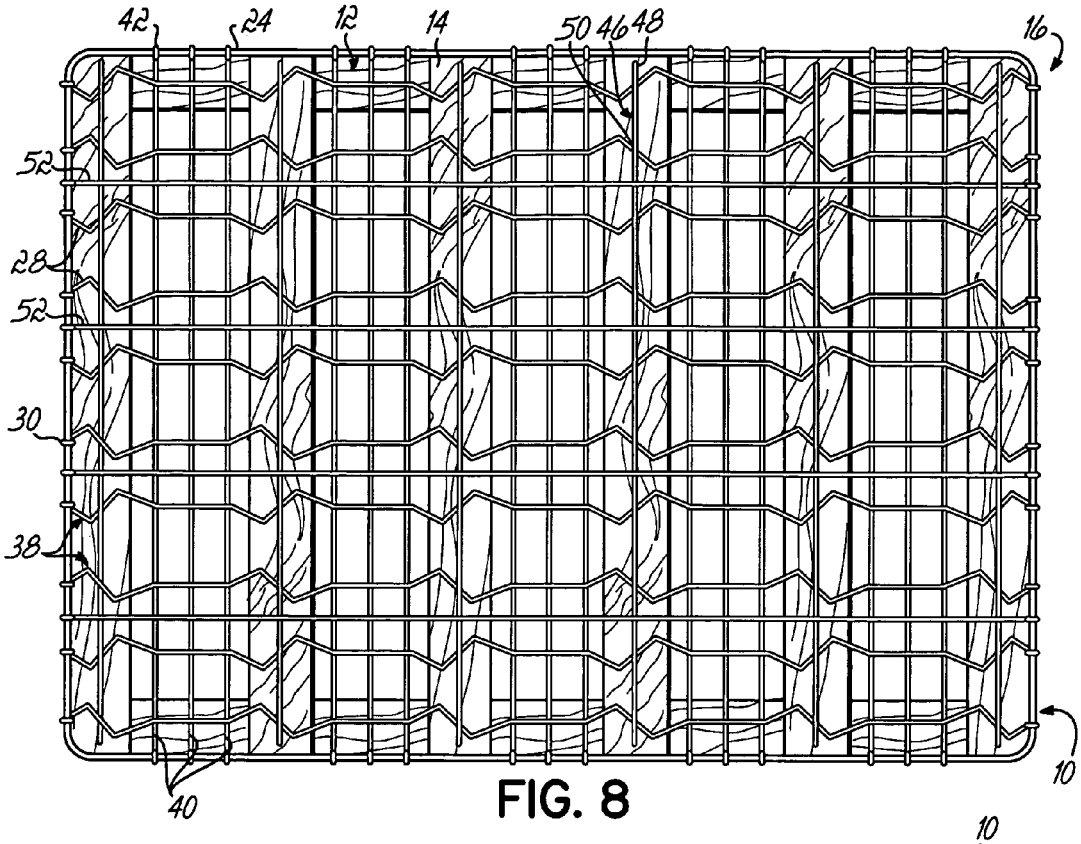
Figure 9:
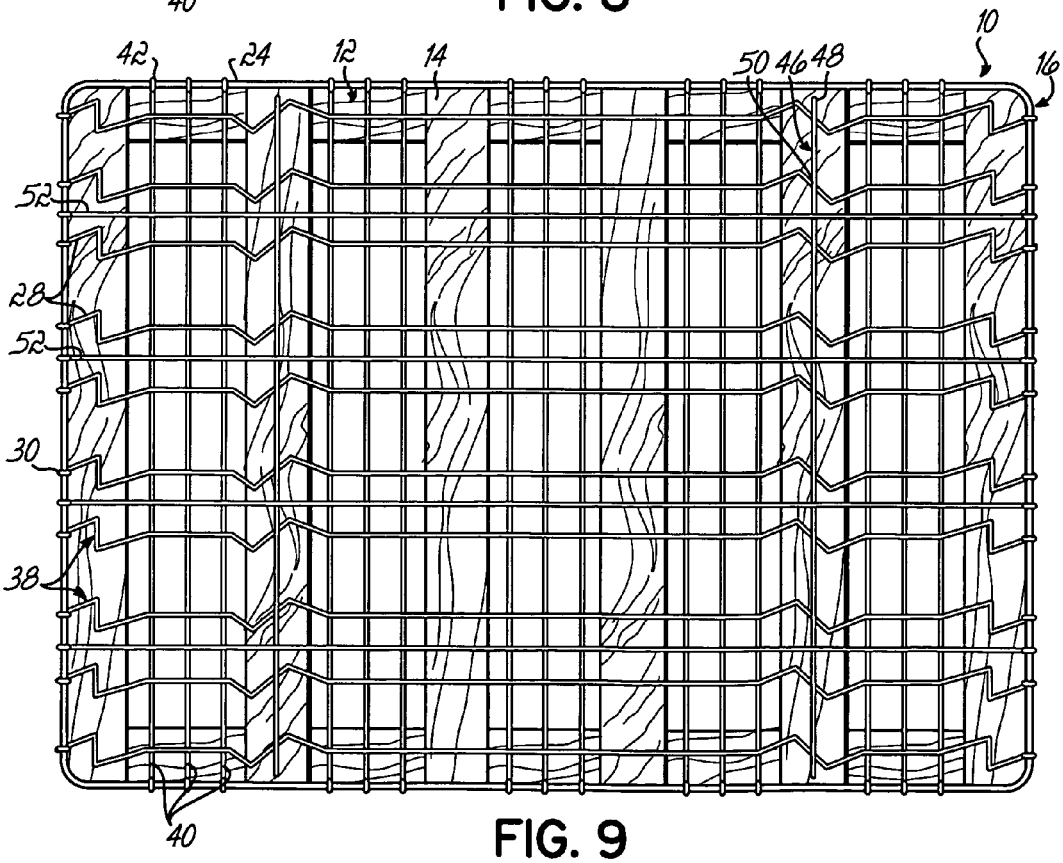

Another alternative embodiment of the foundation unit 10 according to the invention is shown in FIG. 8 and is similar to that shown in FIG. 7 except with respect to the connecting portions 39 adjacent to each distal peak portion 36 of the support wire 28 being generally parallel with each other. The connecting portions 39 adjacent each distal peak portion 36 of the support wires 28 in FIG. 7 are oppositely oriented relative to each other, but in FIG. 8 these portions 39 are similarly oriented A further alternative embodiment of the foundation unit 10 according to this invention is shown in FIG. 9 in which the support wires 28 are generally parallel with each other throughout the foundation unit 10. However, the distal valley portions 38 at the longitudinal ends of the unit 10 are oriented 90° relative to the distal peak portions 36 and the distal valley portions 38 of the adjacent slats 14 are oriented 45° relative to the distal peak portions 36. Moreover, the distal valley portions 38 in the longitudinal central zone of the foundation unit 10 are co-linear with the distal peak portions 36.

Figure 10:
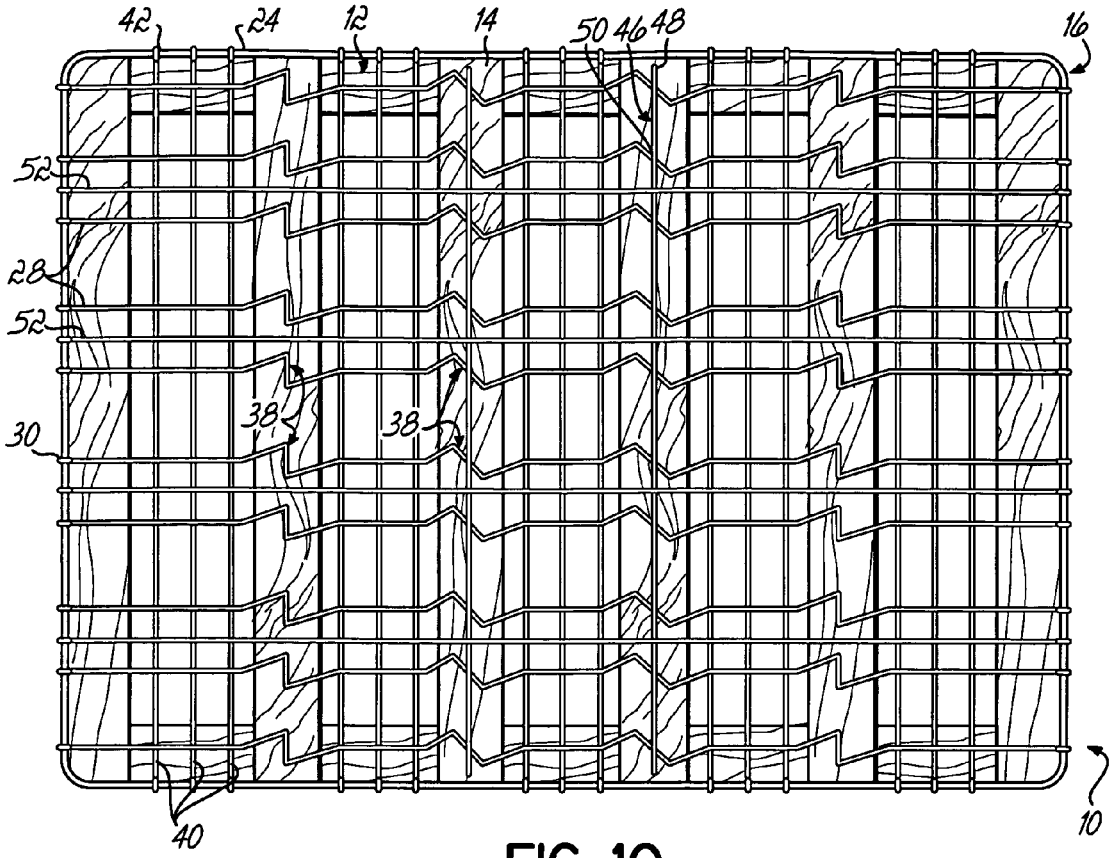

A still further alternative embodiment of the foundation unit 10 according to this invention is shown in FIG. 10 in which the support wires 28 are generally parallel with one another and the distal valley portions 38 in the longitudinal central zone are oriented 45° relative to the distal peak portions 36. The distal valley portions 38 of the adjacent zones are oriented 90° relative to the distal peak portions 36. The distal valley portions 38 adjacent to the ends 26, 26 of the border wire 22 are generally co-linear with the distal peak portions 36 of the foundation unit 10 in FIG. 10.

One advantage of the variety of embodiments possible with the foundation unit 10 according to this invention is the ability to customize the support characteristics of the foundation unit 10. Moreover, the foundation unit 10 may include zones of differing degrees of support and firmness due to the differing orientations of the distal valley portions 38 as is readily apparent from the embodiment shown in FIGS. 9-10.

One of ordinary skill in the art will readily recognize that the alternative embodiments of the foundation unit 10 shown herein are exemplary only of a wide variety of alternative configurations that are readily possible within the scope of this invention.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A bedding foundation comprising:

a rectangular base comprising a rectangular base frame and a plurality of transverse slats;

a spring assembly fixedly attached atop the base;

a foam pad overlying the spring assembly;

a fabric covering overlying the pad and surrounding the spring assembly and base;

the spring assembly comprising, a generally rectangular border wire having two parallel sides and two parallel ends; and a plurality of spaced and longitudinally-extending support wires extending between the border wire ends, each support wire having a plurality of peaks and a plurality of valleys, flattened distal portions of the peaks being generally coplanar with the border wire and flattened distal valley portions being vertically displaced beneath and intermediate of the distal peak portions;

wherein the distal valley portions of the support wires are parallel to the transverse slats of the base with the distal peak portions of the associated support wire being perpendicular to the transverse slats of the base.

2. The bedding foundation of claim 1 further comprising:

a plurality of longitudinally-spaced, parallel, and transversely-extending upper connector wires parallel to the border wire ends and having ends connected to the border wire sides, the upper connector wires being connected intermediate of their ends along their lengths thereof to the distal peak portions of the support wires.

3. The bedding foundation of claim 1 wherein longitudinal voids between the distal peak portions are of a dimension greater than the distal valley portions.

4. The bedding foundation of claim 1 wherein the distal valley portions of the plurality of support wires are arranged throughout the spring assembly to provide zones of differing support characteristics to the spring assembly.

5. The bedding foundation of claim 1 wherein border wire sides are longer than the border wire ends.

6. The bedding foundation of claim 1 wherein each of the support wires is a continuous length of wire.

7. The bedding foundation of claim 1 wherein the support wires are generally parallel with each other.

8. The bedding foundation of claim 1 wherein the support wires comprise a plurality of serially connected generally linear wire segments.

9. A spring assembly for use in a bedding foundation comprising:

a generally rectangular border wire having two parallel sides and two parallel ends; and a plurality of transversely spaced and longitudinally-extending support wires extending between the border wire ends, each support wire having a plurality of peaks and a plurality of valleys, flattened distal portions of the peaks being generally coplanar with the border wire and flattened distal valley portions being vertically displaced beneath and intermediate of the distal peak portions;

wherein selected distal valley portions of the support wires are non-parallel with the distal peak portions of the associated support wire and each of said support wires has ends which are crimped around the ends of the border wire.

10. The spring assembly of claim 9 further comprising:

a plurality of longitudinally-spaced, parallel, and transversely-extending upper connector wires parallel to the border wire ends and having ends connected to the border wire sides, the upper connector wires being connected intermediate of their ends along their lengths thereof to the distal peak portions of the support wires.

11. The spring assembly of claim 9 wherein longitudinal voids between the distal peak portions are of a dimension greater than the distal valley portions.

12. The spring assembly of claim 9 being a first assembly, which, when placed atop a second assembly of like construction, is nestedly stacked thereon when the distal valley portions of the first assembly enter into the voids between the distal peak portions of the second assembly, the nested assemblies having a total height dimension less than a sum of a height dimension of the first assembly plus a height dimension of the second assembly.

13. The spring assembly of claim 9 wherein the flattened distal valley portions are oriented either 90° or 45° relative to the flattened distal peak portions of the associated support wire.

14. The spring assembly of claim 9 wherein border wire sides are longer than the border wire ends.

15. The spring assembly of claim 9 wherein each of the support wires is a continuous length of wire.

16. The spring assembly of claim 9 wherein the support wires are generally parallel with each other.

17. The spring assembly of claim 9 wherein each of the support wires comprises a plurality of serially connected generally linear wire segments.

18. A spring assembly for use in a bedding foundation comprising:

a generally rectangular border wire having two parallel sides and two parallel ends; and a plurality of transversely spaced and longitudinally-extending support wires extending between the border wire ends, each support wire having a plurality of flattened peaks and a plurality of flattened valleys joined with linear connecting portions, the flattened peaks being generally coplanar with the border wire and flattened valleys being vertically displaced beneath and intermediate of the flattened peaks, said flattened valleys being parallel the ends of the border wire and the flattened peaks being parallel the sides of the border wire.

19. The spring assembly of claim 18 wherein each of said support wires has ends which are crimped around the ends of the border wire.

20. The spring assembly of claim 18 further comprising:

a plurality of longitudinally-spaced, parallel, and transversely-extending upper connector wires parallel to the border wire ends and having ends connected to the border wire sides, the upper connector wires being connected intermediate of their ends along their lengths thereof to the distal peak portions of the support wires.

* * * * *